United States Patent [19]

Hamada et al.

[11] Patent Number: 5,064,229

[45] Date of Patent: Nov. 12, 1991

[54] LOCK DEVICE FOR VEHICLE

[75] Inventors: Yoshikazu Hamada; Yozo Ogino, both of Utsunomiya, Japan

[73] Assignee: Mitsui Kinzoku Kogyo Kabushiki Kaisha, Tokyo, Japan

[21] Appl. No.: 514,821

[22] Filed: Apr. 26, 1990

[30] Foreign Application Priority Data

Apr. 27, 1989 [JP] Japan ..... 1-108458
Apr. 28, 1989 [JP] Japan ..... 1-110929

[51] Int. Cl.[5] ..... E05C 3/26

[52] U.S. Cl. ..... 292/216; 292/340; 292/341.12

[58] Field of Search ..... 292/216, DIG. 23, 340, 292/337, 341.52, DIG. 39, DIG. 40, DIG. 41, DIG. 55, DIG. 56, DIG. 73

[56] References Cited

U.S. PATENT DOCUMENTS

| | | | |
|---|---|---|---|
| 1,813,132 | 7/1931 | Andrews | 292/DIG. 39 |
| 1,990,141 | 2/1935 | Seitz | 292/DIG. 39 |
| 3,331,624 | 7/1967 | Pugh | 292/216 |
| 3,371,948 | 3/1968 | Velavicius | 292/DIG. 55 |
| 4,165,112 | 8/1979 | Kleefeldt | 292/216 |
| 4,288,117 | 9/1981 | Nardi | 292/DIG. 41 |
| 4,358,141 | 11/1982 | Hamada | 292/216 |
| 4,679,836 | 7/1987 | Pupillo et al. | 292/DIG. 56 |
| 4,733,892 | 3/1988 | Kleeldt et al. | 292/216 |
| 4,756,563 | 7/1988 | Garwood et al. | 292/216 |
| 4,941,696 | 7/1990 | Yamada et al. | 292/340 |

FOREIGN PATENT DOCUMENTS

| | | | |
|---|---|---|---|
| 103904 | 3/1984 | European Pat. Off. | 292/DIG. 23 |
| 272116 | 6/1988 | European Pat. Off. | 292/340 |

*Primary Examiner*—Eric K. Nicholson
*Attorney, Agent, or Firm*—Browdy and Neimark

[57] ABSTRACT

The lock device for a vehicle in accordance with the present invention comprises a synthetic resin body fixed to a door and equipped with a recess formed on its right side; a latch fitted rotatably into the recess; a striker fixed to a car body and having a front leg portion having a small diameter and meshing with the latch, a rear side leg portion having a large diameter and a wedge-like bridge portion connecting the tips of the leg portions and having a thin front portion and a thick rear portion; a guide groove formed on the body and permitting the entrance of the striker; front side clamp means disposed on the front side of the guide groove, for clamping the front side of the striker; and rear side clamp means disposed on the rear side of the guide groove, for clamping the rear side portion of the striker. A swell portion defining the guide groove is formed integrally on the back side of the body and a metallic back plate is fixed to this back side. A plurality of retainers for receiving the swell force to the swell portion, that occurs when the striker is clamped, are formed on the back plate.

6 Claims, 4 Drawing Sheets

LOCK DEVICE FOR VEHICLE

FIELD OF THE INVENTION

This invention relates to a lock device for a vehicle.

DESCRIPTION OF THE PRIOR ART

U.S. Pat. No. 3,331,624 discloses a lock device for a vehicle which comprises a lock body fixed to a door; a guide groove which is formed on the body and into which a striker fixed to the car body fits; a latch disposed rotatably on the body and meshing with the striker; and a wedge which is disposed at the lower part of the guide groove and comes into contact with the striker and moves to a depth side; and wherein the striker is clamped between the upper surface of the wedge and the upper surface of the guide groove when the striker fits into the guide groove.

In the prior art example described above, only the tip portion of the striker is clamped between the upper surface of the wedge and the upper surface of the guide groove and the intermediate portion and rear end portion of the striker are free with respect to the body Therefore, the lock device cannot restrict sufficiently the shake of the door.

On the other hand, U.S. Pat. No. 4,165,112 discloses a lock device for a vehicle having a structure wherein upper and lower surfaces of a guide groove of a body are freely movable in a vertical direction. In this prior art device, the intermediate portion of a striker is clamped flexibly by the upper and lower moving surfaces whereas the tip portion and rear end portion of the striker are free from the lock body. In accordance with this structure wherein only the intermediate portion of the striker is clamped flexibly, however, there remains the problem in that the shake of the door cannot be restricted sufficiently unless resiliency of the moving surfaces is considerably strong. If resiliency of the moving surfaces is increased considerably, however, the resistance increases when the striker enters the guide groove and smoothness of the door opening/closing operation will be lost.

SUMMARY OF THE INVENTION

It is an object of the present invention to provide a lock device which can sufficiently restrict shake of a door even with low resilience by clamping the tip and rear end portions of a striker by a lock body.

DESCRIPTION OF THE PREFERRED EMBODIMENT

Figure 1:
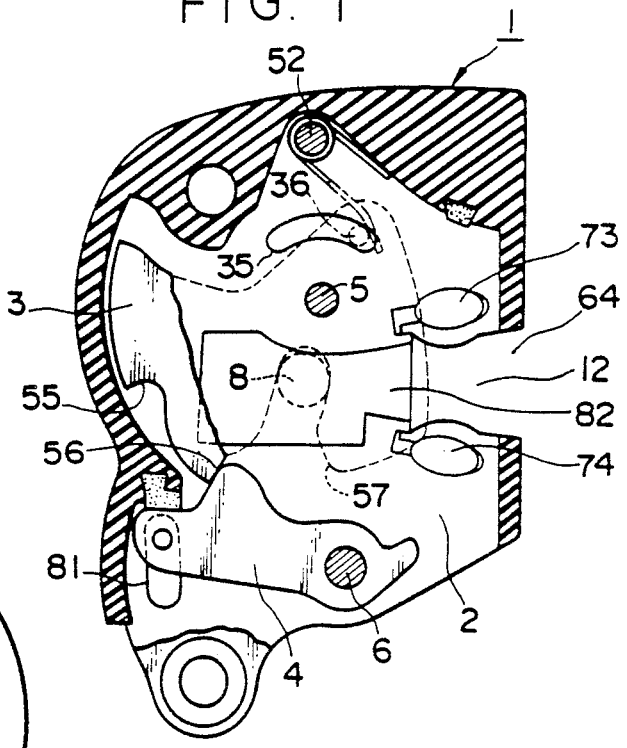
FIG. 1 is a longitudinal sectional front view of the body of a lock device in accordance with the present invention.

Hereinafter, an embodiment of the present invention will be described with reference to the accompanying drawings. A recess 2 is formed on the front side of a synthetic resin body 1 of a lock device which is fixed to a door, and a swell portion 13 is formed on its back side. A latch 3 meshing with a striker 8 fixed to a car body is fitted rotatably inside the recess 2 by a shaft 5 and a ratchet 4 meshing with steps 55, 56 of the latch 3 is disposed also rotatably inside the recess 2 by a shaft 6 so as to prevent reverse rotation of the latch 3.

Figure 5:
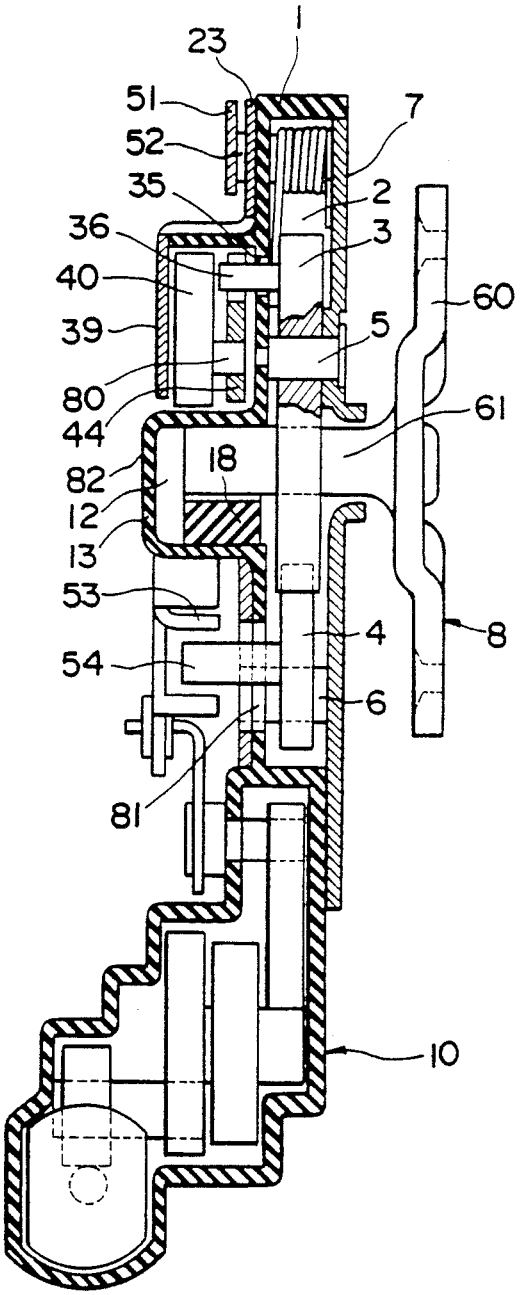
FIG. 5 is a longitudinal sectional side view of the lock device.

As shown in FIG. 5, the striker 8 consists of a vertical plate 60 fixed to the car body side and a rod 61 fixed at right angles to the vertical plate 60. The rod 61 is U-shaped as a whole and consists of a front leg portion 21 having a small diameter and meshing with an engagement groove 57 of the latch 3, a rear leg portion 22 having a large diameter and a bridge portion 11 connecting the tips of these leg portions 21 and 22 to each other. The bridge portion 11 has a wedge-like shape whose front side is thin and whose rear side is thick. The bridge portion 11 enters the body through a guide groove 12 which is defined by the inner wall of the swell portion 13 described above.

Figure 4:
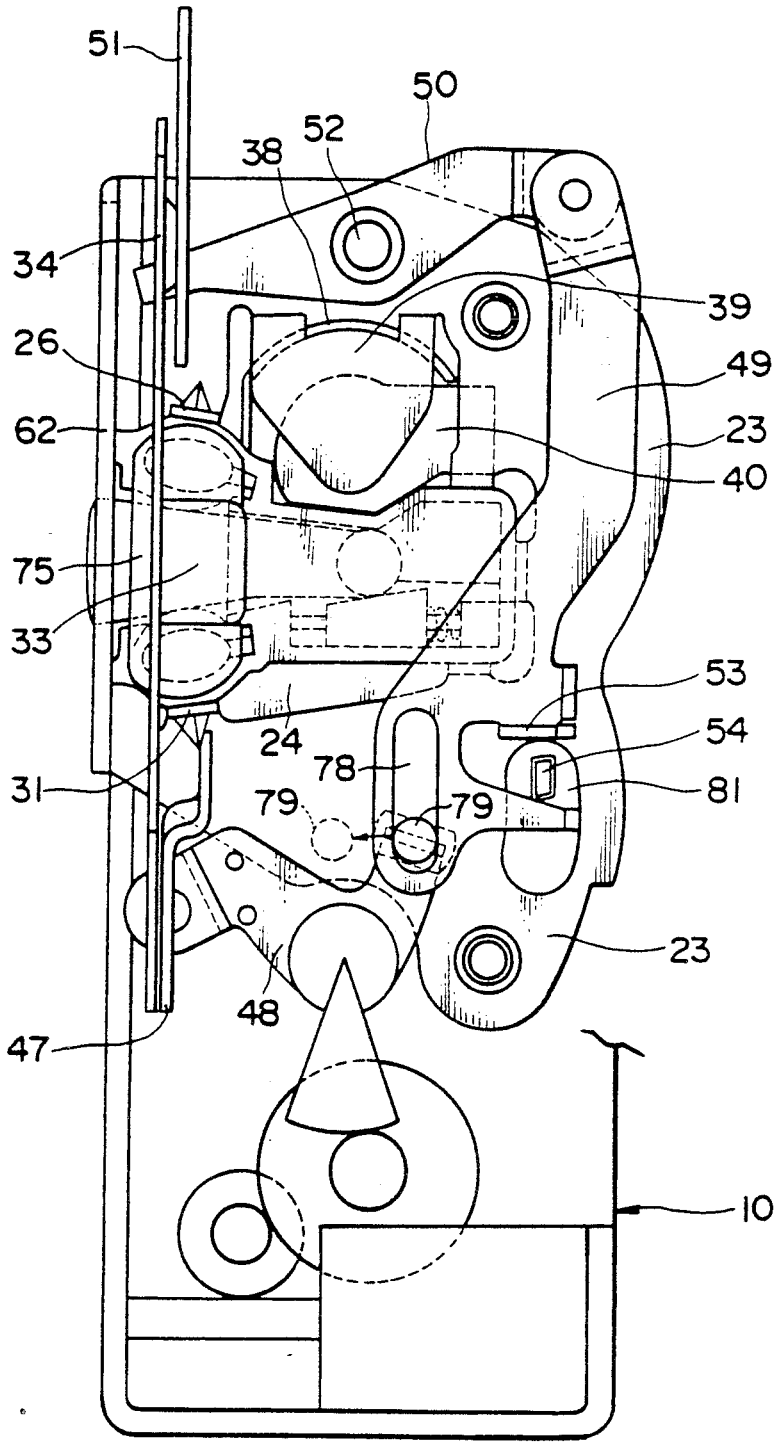
FIG. 4 is a rear view of the lock device.
Figure 6:
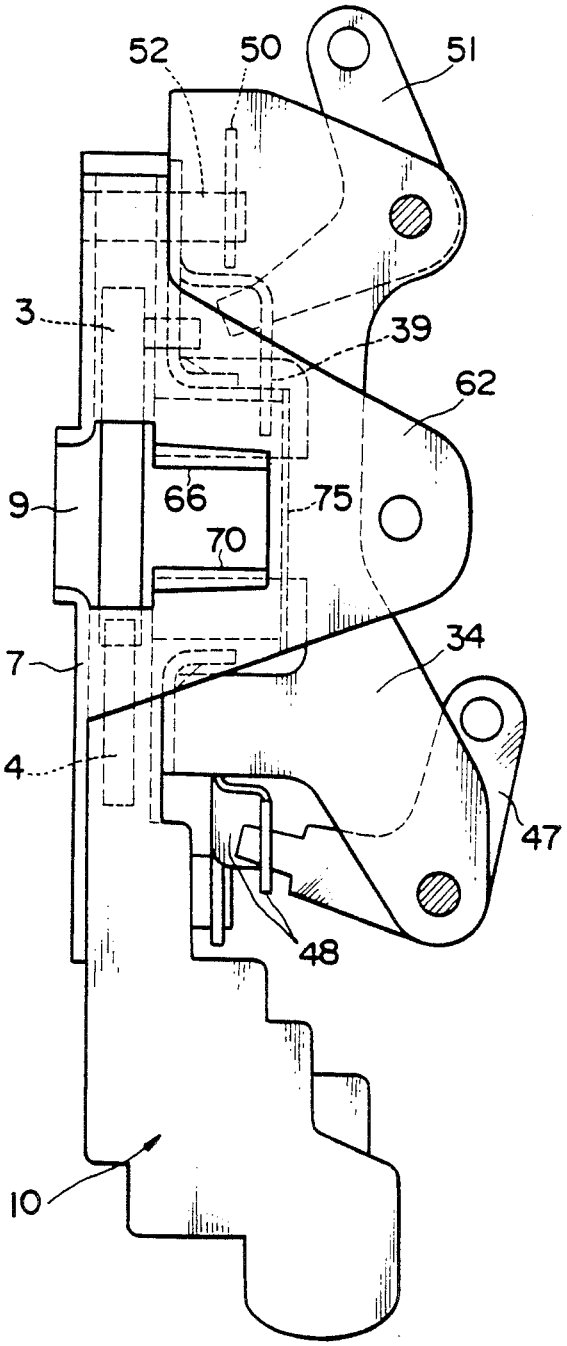
FIG. 6 is a right-hand side view of the lock device.

A actuator 10 is disposed sometimes at the lower part of the body 1, whenever necessary in accordance with the intended application, as shown in FIGS. 4 through 6.

A metallic plate 7 for covering the recess 2 is fixed to the front side of the body 1. The cover plate 7 has a side plate 62 which is bent at right angles (FIG. 6) and exhibits an L-shape as a whole. A notch groove 9 is defined at the portion of the plate 7 where the striker 8 passes.

Figure 7:
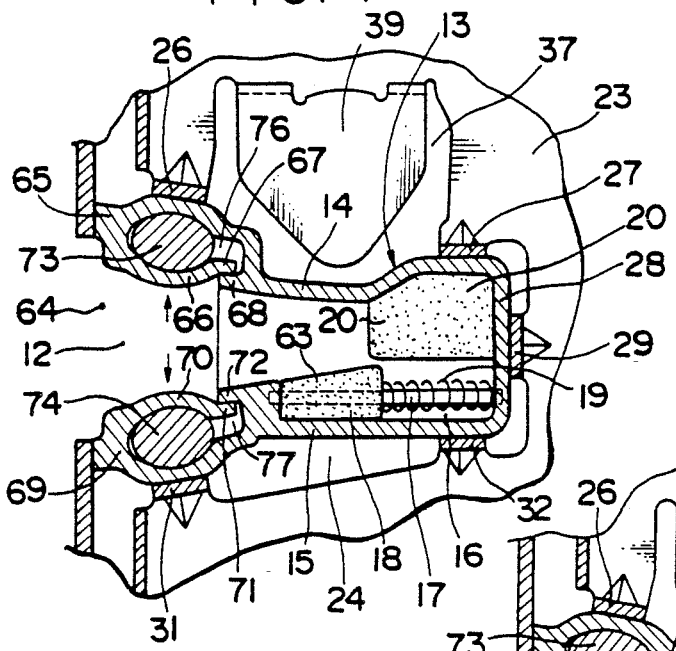
FIG. 7 is a sectional view of a guide groove of the body when the door is open.
Figure 8:
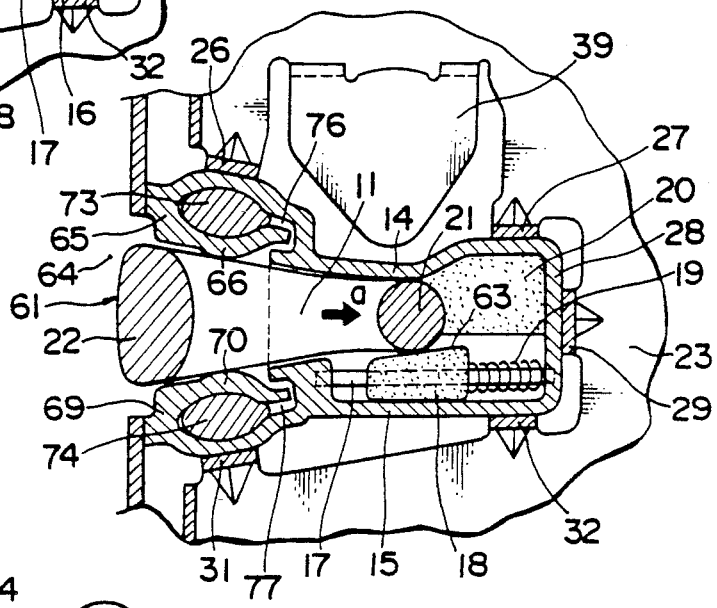
FIG. 8 is a sectional view of the guide groove of the body when the door is closed.

The swell portion 13 has an upper wall 14, a lower wall 15, a bottom wall 82 and a side wall 28, and exhibits a substantially C-shaped longitudinal sectional shape (FIG. 5), as shown in the sectional views of FIGS. 7 and 8. As shown in FIGS. 7 and 8, a recess 16 facing downward is formed on the depth side of the lower wall 15 (on the right side in FIGS. 7 and 8) and a shaft 17 which is in parallel with the moving direction a of the striker 8 described above is disposed in the recess 16. A synthetic resin wedge 18 having an inclined upper surface 63 which is substantially in parallel with the lower surface of the bridge portion 11 of the striker 8 is fitted idlely in such a manner as to be capable of moving to the right and left. The length of the wedge 18 is smaller than that of the recess 16 and is always biased by a spring 19 to an entrance 64 side of the guide groove 12 described above. Accordingly, under the door opening state shown in FIG. 7, the wedge 18 is positioned on the entrance 64 side but when the door is closed, the wedge 18 moves to the inner side due to its abuttment with the bridge portion 11 as shown in FIG. 8. In consequence, the front side of the wedge 18 is firmly clamped between the upper surface 63 of the wedge 18 and the lower surface of the upper wall 14 and shake a the time of closing of the door can thus be prevented.

The entrance 64 of the guide groove 12 is wider than the depth portion and exhibits a flare-like shape as a whole which is similar to that of the bridge portion 11. A buffer material 20 to which the bridge portion 11 strikes is disposed on the depth side of the guide groove 12.

The entrance 64 side of the upper wall 14 is shaped in a substantially annular cylinder portion 65. The arcuate inner wall 66 at the lower part of this cylinder portion 65 has a free tip 67 and this free tip 67 is meshed with an engagement portion 68 formed on the upper wall 14. A cylinder portion 69 is likewise formed on the lower wall 15 as in the upper wall 14 and the tip 71 of the arcuate inner wall 70 of this cylinder portion 69 is meshed with an engagement portion 72 of the lower wall 15. A flexible member 73, 74 such as rubber is fitted into each cylinder portion 65, 69. The flexible members 73 and 74 are connected integrally with each other by a connecting member 75 (see FIG. 2).

When the door is open as shown in FIG. 7, the arcuate inner walls 66 and 70 are expanded by the respective flexible members 73 and 74. The gap between the arcuate inner walls 66 and 70 under the expanded state is greater than the width of the front end portion of the bridge portion 11 but is narrower than the width at the rear end portion. When the bridge portion 11 enters the guide groove 12, the rear end portion of the bridge portion 11 pushes the arcuate inner walls 66, 70 so that they move within the range of the gaps 76, 77 and clamp flexibly and from above and below the rear end portion of the bridge portion 11. Accordingly, the bridge portion 11 of the striker 8 is held firmly both on its front and rear sides.

Figure 3:
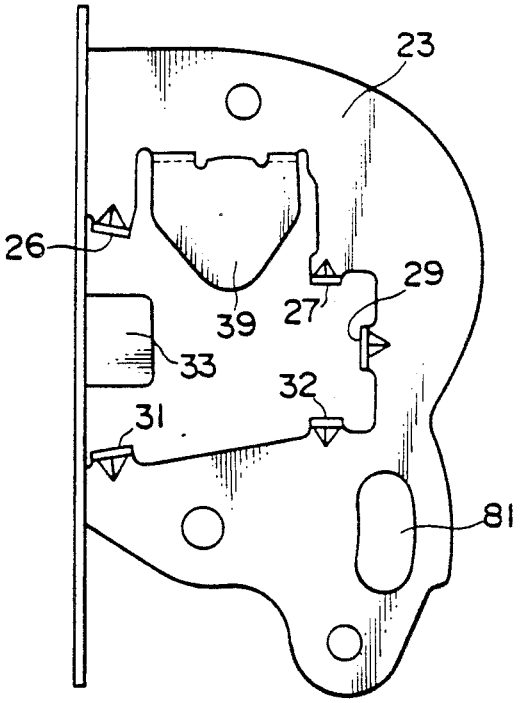
FIG. 3 is a rear view of a back plate.

A metallic back plate 23 is disposed on the back of the body 1. The back plate 23 is equipped on one of its sides with a bent portion 34 which is bent at right angles on the back side (see FIGS. 3 and 6).

A window hole 24 which is a little greater than the swell portion 13 is formed in the back plate 23. Retainers 26, 31 coming into contact with the upper and lower walls of the entrance 64 portion of the swell portion 13, retainers 27, 32 coming into contact with the upper and lower walls on the depth side of the swell portion 13 and a retainer 29 coming into contact with the side wall 28 of the swell portion 13 are formed in the window hole 24. These retainers reinforce the respective walls of the swell portion 13. In other words, when the front side of the bridge portion 11 and its rear side are firmly held by the upper wall 14 and the wedge 18 and by the arcuate inner walls 66, 70, respectively, the strong force in the swelling direction acts on each wall of the swell portion due to the reaction, and each retainer described above receives this force. Part of the bent portion 34 is bent so as to form a retainer 33 which supports from above the connecting member 75 of the flexible members 73, 74 to prevent their fall-off.

Figure 2:
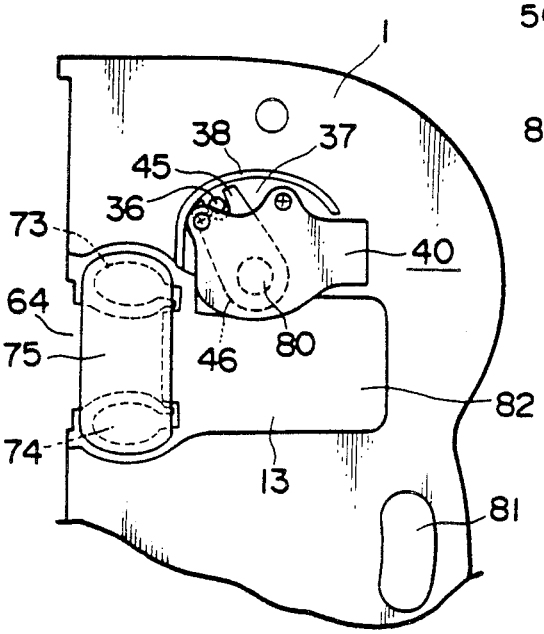
FIG. 2 is a rear view of the body.

A box 37 for storing the switch 40 which detects the rotating position of the latch 3 is formed at the upper position of the swell portion 13 on the back side of the body 1 (FIG. 2). The upper part of this box 37 is partitioned by an arc-like enclosure wall 38 which is made of a synthetic resin and integral with the body 1 and its lower part, by the upper wall 14 of the swell portion 13. The back side of the switch box 37 is covered with a cover 39 formed integrally with the back plate 23 (FIG. 4). Though the switch 40 may be fixed inside the box 37, it is suitably fixed by a screw to the cover 39. If the box 37 is formed on the back surface side of the body 1, it is possible to obtain a lock device which can be assembled easily without increasing the size of the body 1.

Figure 9:
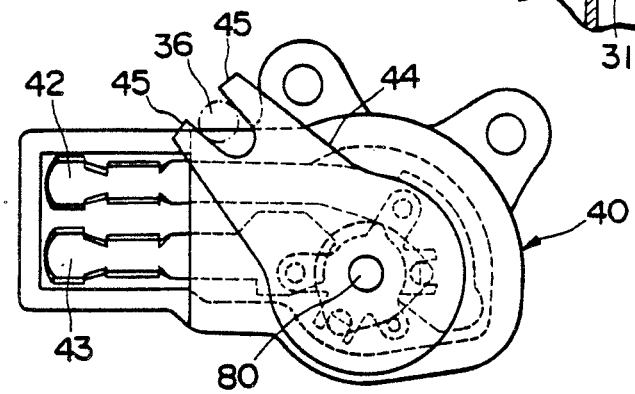
FIG. 9 is a front view of the switch.
Figure 10:
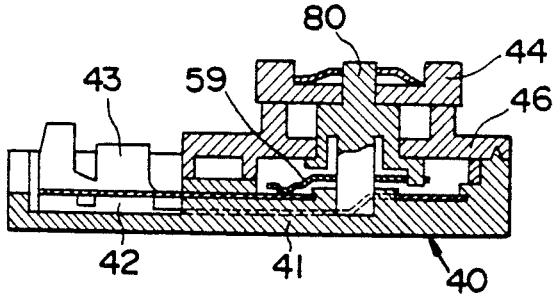
FIG. 10 is a sectional view of the switch.

The structure of the switch 40 described above is arbitrary and its one example is shown in FIGS. 9 and 10. A pair of fixed contact plates 42, 43 are fitted to the synthetic resin case 41 of the switch 40 (FIGS. 9 and 10). A shaft 80 to which a contact 59 is fixed (FIG. 10) is fitted rotatably to a water-proofing cover 46 of the case 41 and the base portion of the lever 44 is fixed to an outwardly projecting portion of this shaft 80. The axis of the shaft 80 is positioned on the same axial line as the shaft 5 of the latch 3. A bifurcate portion 45 is formed at the tip of the lever 44.

A protuberance 36 that projects into the switch box 37 through the window hole 35 formed in the body 1 is provided to the rotary portion of the latch 3 (FIGS. 1, 5) and the tip of this protuberance 36 is meshed with a bifurcate portion 45 of the lever 44 described already. Therefore, when the latch 3 rotates due to its engagement with the striker 8, the lever 44 rotates through the protuberance 36 and the rotating state of the latch 3 can be detected. Accordingly, the open/close state of the door can be confirmed, and a room lamp, a passive seat belt, and the like, can be controlled.

The intermediate portion of an open lever 50 is fitted rotatably by a shaft 52 on the upper back side of the body 1. As shown in FIG. 4, the left end of the open lever 50 meshes with a rotaty lever 51 which is connected to an open handle (not shown) of the door. The upper end of a link 49 equipped with an elongated hole 78 at its lower end is connected to this open lever 50. A protuberance 79 fixed to the lock lever 48 is meshed with this elongated hole 78.

A pin 54 which projects to the back side through a through-hole 81 formed on the body 1 is provided to the ratchet 4 (FIG. 5). A contact plate 53 meshing with and disengaging from the pin 54 is formed on the link 49. The lock lever 48 is rotated by the operation of the rotary lever 47 or an actuator which is rotated by the locking and unlocking operation of a sill knob (or a key). In FIG. 5, the position of the protuberance 79 represented by solid line is the unlock position. When the link 49 moves up due to the rotation of the open lever 50, the contact plate 53 moves up the pin 54 to rotate the ratchet 4 and to thereby release the engagement between the latch 3 and the striker 8. The position of the protuberance 79 represented by dash line is the lock position, where the contact plate 53 does not engage with the pin 54 even when the link 49 moves up, and the door cannot be opened.

What is claimed is:

1. A lock device for a vehicle comprising:

a synthetic resin body fixed to a door and having a recess formed on its side;

a latch fitted rotatably into said recess;

a striker fixed to a car body and having a front leg portion having a small diameter and meshing with said latch, a rear leg portion having a large diameter and a wedge-like bridge portion connecting tips of said leg portions and having a thin front side and a thick rear side;

a guide groove formed on said body and permitting the entrance of said striker;

front side clamp means for clamping a front side portion of said striker, disposed on the front side of said guide groove; and rear side clamp means for clamping a rear side portion of said striker, disposed on the rear side of said striker wherein said front side means is independent of said rear side clamp means whereby each can be operated independently of the other.

2. A lock device for a vehicle according to claim 1, wherein said front side clamp means has a wedge which strikes the front side portion of said striker and moves towards a depth side.

3. A lock device for a vehicle according to claim 1, wherein said rear side clamp means has a pair of upper and lower movable inner walls for clamping flexibly the rear side portion of said bridge portion.

4. A lock device for a vehicle according to claim 1, wherein said front side clamp means has a wedge which strikes the front side portion of said striker, and moves towards a depth side, and said rear side clamp means has a pair of upper and lower movable inner walls for clamping flexibly the rear side portion of said bridge portion.

5. A lock device for a vehicle according to claim 1, wherein a swell portion for defining said guide groove is formed integrally on a back side of said body, a metallic back plate is fixed to the back side of said body and a plurality of retainers for receiving a swelling force to said swell portion that develops when said striker is clamped, are formed on said back plate.

6. The lock device of claim 1, wherein said rear side clamp means and said front side clamp means each exert a force on a separate surface are of said respective front side clamp means and rear side clamp means.

* * * * *